US012588766B2

(12) United States Patent
Smit

(10) Patent No.: US 12,588,766 B2
(45) Date of Patent: Mar. 31, 2026

(54) SEAT COMPRISING A FRAME AND A COVER, AND METHOD OF MANUFACTURING THE SAME

(71) Applicant: F. SMIT HOLDING B.V., Doetinchem (NL)

(72) Inventor: Fernando Smit, Doetinchem (NL)

(73) Assignee: F. SMIT HOLDING B.V., Doetinchem (NL)

( * ) Notice: Subject to any disclaimer, the term of this patent is extended or adjusted under 35 U.S.C. 154(b) by 112 days.

(21) Appl. No.: 18/283,724

(22) PCT Filed: Mar. 24, 2022

(86) PCT No.: PCT/NL2022/050163
§ 371 (c)(1),
(2) Date: Sep. 22, 2023

(87) PCT Pub. No.: WO2022/203511
PCT Pub. Date: Sep. 29, 2022

(65) Prior Publication Data

US 2024/0298802 A1 Sep. 12, 2024

(30) Foreign Application Priority Data

Mar. 25, 2021 (NL) ..... 2027841

(51) Int. Cl.
*A47C 5/06* (2006.01)
*A47C 3/026* (2006.01)
(Continued)

(52) U.S. Cl.
CPC ..... *A47C 5/06* (2013.01); *A47C 3/026* (2013.01); *A47C 5/10* (2013.01); *A47C 7/029* (2018.08)

(58) Field of Classification Search
CPC .... A47C 5/10; A47C 5/06; A47C 5/08; A47C 1/146; A47C 1/143; A47C 3/026; A47C 7/029
See application file for complete search history.

(56) References Cited

U.S. PATENT DOCUMENTS 1,317,580 A * 9/1919 Kanode ..... A47C 3/029 297/272.1
2,564,915 A * 8/1951 Nelson ..... A47C 3/023 297/440.11
(Continued)

FOREIGN PATENT DOCUMENTS

CA 2985983 A1 * 5/2018 ..... A47C 1/14
CN 202567263 U * 12/2012
(Continued)

OTHER PUBLICATIONS

International Search Report and Written Opinion for the International Application No. PCT/NL2022/050163, mailed Apr. 29, 2022, 11 pages.

*Primary Examiner* — Timothy J Brindley
(74) *Attorney, Agent, or Firm* — KDW Firm PLLC

(57) ABSTRACT

A seat including a frame and a cover and having a seat surface and a backrest. The frame includes two side profiles lying at a mutual distance and delimiting the seat surface, two side profiles lying at a mutual distance and delimiting the backrest, and an upper profile extending between the side profiles. The seat surface and the backrest are defined by a cloth tensioned between the profiles. This cloth has at an end a folded-back part enclosing the upper profile, and a strap folded round the side profiles for the seat surface. A method for forming such a seat, and a frame and a cloth which are both intended for application in such a seat.

26 Claims, 11 Drawing Sheets

Figure 1:
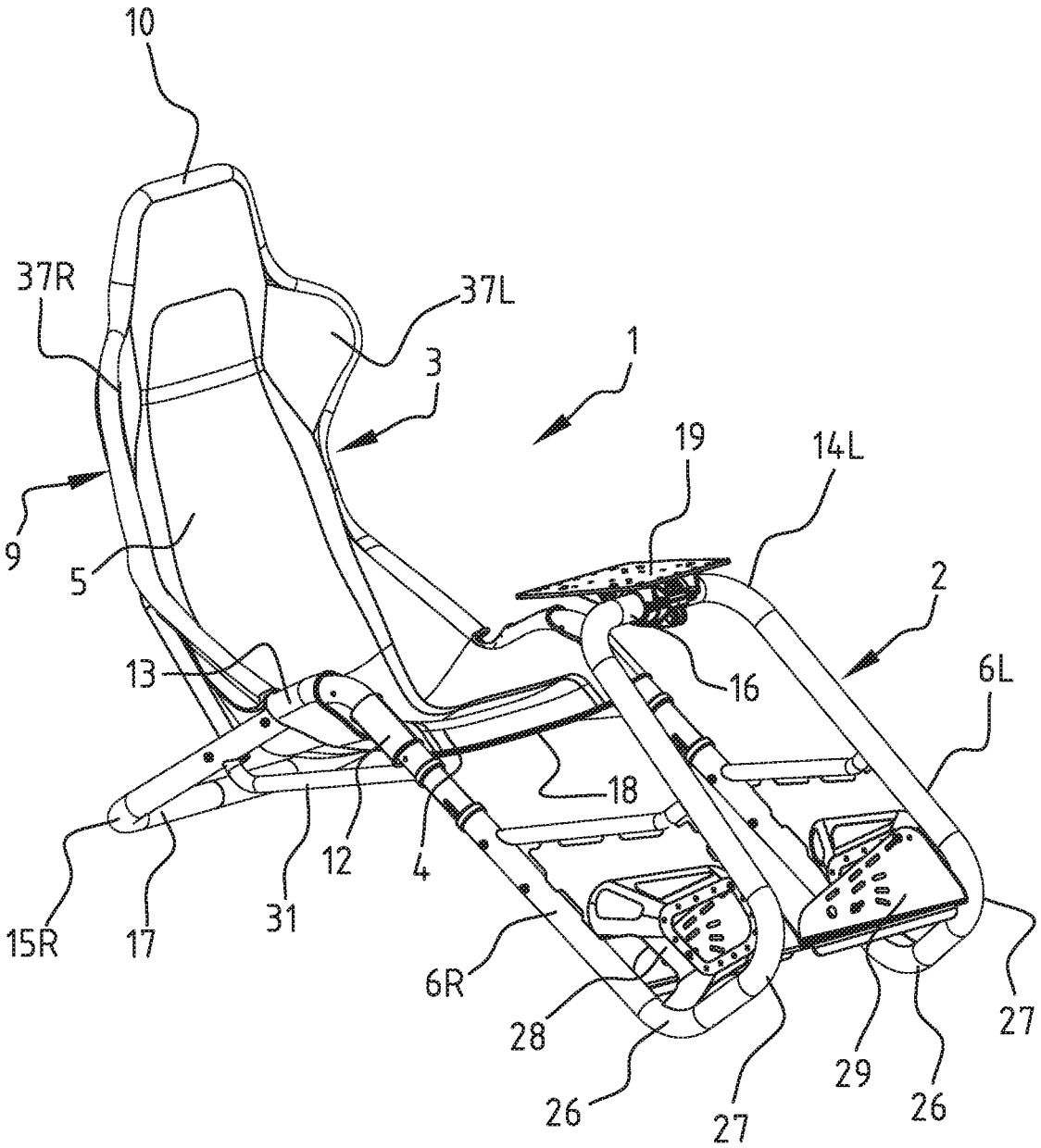

(51) Int. Cl.
*A47C 5/10* (2006.01)
*A47C 7/02* (2006.01)

(56) References Cited

U.S. PATENT DOCUMENTS

| | | | | | |
|---|---|---|---|---|---|
| 2,586,262 | A * | 2/1952 | Robins | A47C 3/023 5/120 |
| 2,628,660 | A * | 2/1953 | Mcdonald | A47C 5/06 297/287 |
| 3,708,204 | A * | 1/1973 | Wachsmann | A47C 4/03 108/156 |
| 3,907,363 | A * | 9/1975 | Baker | A47C 5/06 297/DIG. 2 |
| 4,784,436 | A * | 11/1988 | Sutherland | A47C 4/02 297/440.11 |
| 7,387,332 | B2 * | 6/2008 | Piretti | A47C 1/028 297/118 |
| 10,104,971 | B1 * | 10/2018 | Yang | A47C 5/10 |
| 10,631,651 | B1 * | 4/2020 | Hsu Besner | A47C 4/28 |
| 10,821,354 | B2 * | 11/2020 | Smit | A63F 13/24 |
| D907,141 | S * | 1/2021 | Wang | D21/690 |
| 10,932,549 | B1 * | 3/2021 | DeMaio | A47C 7/622 |
| 11,419,423 | B1 * | 8/2022 | Wu | A47C 7/40 |
| 2008/0157580 | A1 * | 7/2008 | Lin | A47C 31/023 297/391 |
| 2021/0204699 | A1 * | 7/2021 | Deevers | A47C 1/0308 |
| 2021/0330083 | A1 * | 10/2021 | Lu | D03D 3/00 |

FOREIGN PATENT DOCUMENTS

| | | | | | |
|---|---|---|---|---|---|
| CN | 108308908 | A * | 7/2018 | A47C 1/024 |
| DE | 3031664 | A1 | 10/1982 | |
| DE | 202006008478 | U1 * | 12/2006 | A47C 1/143 |
| DE | 202012101275 | U1 * | 7/2012 | A47C 31/02 |
| DE | 202016006473 | U1 * | 1/2017 | |
| EP | 1161905 | A1 * | 12/2001 | A47C 7/402 |
| EP | 2110051 | A1 * | 10/2009 | A47C 31/023 |
| EP | 4316946 | A1 * | 2/2024 | A47C 1/143 |
| FR | 946197 | A * | 5/1949 | |
| FR | 1298526 | A * | 7/1962 | |
| RU | 2177239 | C1 | 12/2001 | |
| RU | 218972 | U1 * | 6/2023 | |
| RU | 2809990 | C2 * | 12/2023 | A47C 15/004 |
| WO | WO-9816140 | A1 * | 4/1998 | A47C 1/031 |
| WO | 03013899 | A2 | 2/2003 | |
| WO | WO-2009089167 | A1 * | 7/2009 | A47C 15/004 |
| WO | WO-2017082316 | A1 * | 5/2017 | A47C 3/026 |
| WO | 2018030894 | A1 | 2/2018 | |
| WO | 2020139087 | A1 | 7/2020 | |
| WO | 2020185072 | A1 | 9/2020 | |
| WO | WO-2021023868 | A1 * | 2/2021 | A47C 3/02 |
| WO | WO-2021023870 | A1 * | 2/2021 | A47C 1/00 |

* cited by examiner

SEAT COMPRISING A FRAME AND A COVER, AND METHOD OF MANUFACTURING THE SAME

This application is a national stage filing under 35 U.S.C. 371 of pending International Application No. PCT/NL2022/050163, filed Mar. 24, 2022, which claims priority to Netherlands patent application 2027841, filed Mar. 25, 2021 the entirety of which applications are incorporated by reference herein.

The invention relates to a seat with a frame and a cover, wherein the seat has a seat surface and a backrest. The invention relates particularly to a seat for playing video games. Such a seat is generally known.

Seats for playing video games are known in many variants. Some seats mimic a seat in for instance a car or aircraft, and are thereby optimized for simulator games. Other seats are in fact adapted desk chairs suitable both for normal office use and for playing video games.

The invention has for its object to provide a seat of the above-described type which is sturdy and which provides sufficient support for users of different builds, yet is still sufficiently light and compact to be stored in simple manner when the seat is temporarily not in use. According to the invention, this is achieved in such a seat in that the frame comprises two side profiles lying at a mutual distance and delimiting the seat surface, two side profiles lying at a mutual distance and delimiting the backrest, and an upper profile extending between the side profiles, and wherein the seat surface and the backrest are defined by a cloth tensioned between the profiles, which cloth comprises at an end a folded-back part enclosing the upper profile, and at least one strap folded at least partially round the side profiles for the seat surface.

Embodying the seat surface and backrest as a cloth which is tensioned between profiles of the frame enables the seat to be embodied lighter than a conventional seat wherein the seat surface and the backrest are formed by form-retaining structural parts which are covered with a soft material. The cloth can also be detached in simple manner, for instance for cleaning it or replacing or exchanging it. The function of the seat can thus be determined by selecting a specific type of sleeve, making the frame multifunctional. A sleeve for a seat of a racing car is for instance different than a sleeve for an aircraft seat, and an ergonomically sound sleeve for a desk chair is different than a sleeve optimized for gamers. Finally, the cloth can also be stored considerably smaller than a conventional seat surface and backrest.

In an embodiment of the seat the side profiles which delimit the seat surface each have a front and rear end and are connected to each other close to at least one of the ends by a transverse profile, and the cloth lies clear of the transverse profile. With the transverse profile the side profiles are connected into a sturdy frame but, because the cloth is kept clear of the transverse profile, the seating comfort is not affected hereby.

For an optimal rigidity of the frame the side profiles can be mutually connected close to the two ends by a front and a rear transverse profile, wherein the cloth lies clear of the two transverse profiles.

In an embodiment of the seat the front transverse profile lies higher than the rear transverse profile, and is configured for receiving a control element of a video game. The control element, for instance a steering wheel or control stick, can thus be placed in an optimal position relative to the seat surface and the backrest of the seat.

In yet another embodiment the side profiles which delimit the seat surface each have between their front and rear end a bent portion which lies higher than at least one of the front and rear ends. This bent portion strengthens the frame.

When the front transverse profile carries the control element, this higher front transverse profile can here lie between the bent portion and a front point of each of the side profiles. Placing the front transverse profile behind the front point enables the control element to be positioned at an ergonomically optimal distance from the seat surface and backrest.

In order to be able to adjust the frame of the seat to users of different sizes the side profiles delimiting the seat surface can in an embodiment each be length-adjustable between the bent portion and the front transverse profile. In this way the seat can be used by both children and adults. Owing to the adjustability at this location the shape of the frame does not change, or hardly so, when the length is varied. The length can thereby be adjusted to a user in simple manner without other adjustments of the frame also being necessary here.

In a further embodiment the side profiles delimiting the seat surface can each be divisible between the bent portion and the front transverse profile. The frame of the seat can thus be taken apart and packaged small for storage.

In another embodiment of the seat the side profiles delimiting the seat surface have on either side of the bent portion a front and rear lowermost point, and the lowermost points define support points of the frame on a ground surface. The frame is thus positioned with the bent side profiles directly on the ground, whereby a stable seat is obtained which is well suited for playing video games, wherein a user will often exert great forces on the frame.

In an embodiment the cloth comprises at least two straps which extend at least partially under the side profiles for the seat surface and which are folded round the relevant side profile on either side of the bent portion. By attaching the cloth to the frame in front of and behind the bent portion the position of the seat surface is precisely determined.

In an embodiment forming a desk chair the or each transverse profile can be mounted on an undercarriage. The side profiles, and thereby the seat surface, hereby come to lie at a height above the ground such that a user seated on the seat is able to work at a table top or desk. Owing to the specific shape of the seat surface and the backrest, the seat will still be well suited for playing video games when a screen and control elements of the video game are on the table top or desk.

The undercarriage can here comprise a central leg, and the frame can be rotatable about a longitudinal axis of the central leg.

In order to enable relatively simple storage of the seat the side profiles delimiting the backrest and the upper profile can form an auxiliary frame which can be mounted releasably on the side profiles delimiting the seat surface. The different frame parts can thus be packaged small.

A support which determines an angle between the side profiles can here be arranged between each side profile delimiting the backrest and the corresponding side profile delimiting the seat surface. A robust construction is thus still obtained despite the releasable connection.

In an embodiment of the seat the supports can then be adjustable and the auxiliary frame can be connected movably to the side profiles delimiting the seat surface. The position of the auxiliary frame relative to the rest of the frame, so the side profiles delimiting the seat surface, can thus be varied, and thereby therefore also the angle of the backrest relative to the seat surface.

When the side profiles delimiting the backrest each have a profile part protruding forward from a main plane of the auxiliary frame, the backrest can be provided with protruding edges whereby the body of a user is optimally supported during gameplay.

In an embodiment of the seat the auxiliary frame can have a substantially reverse U-shape. The auxiliary frame then consists substantially only of the side profiles and the upper profile, and thereby takes a relatively light form.

It is on the other hand also possible for a lower profile to further extend between the side parts delimiting the backrest, and for the cloth to be connected to the lower profile. The auxiliary frame thus forms in fact a closed section and thereby provides additional strength to the frame of the seat. Connecting the cloth to the lower profile furthermore enables for instance a transition between the seat surface and the backrest to be fixed.

Although the cloth is already attached firmly to the frame by the folded-back part which encloses the upper profile, the backrest can be defined still further when the cloth comprises at least one strap extending at least partially behind the side profiles for the backrest. The cloth is thus tensioned round the frame even more tightly.

A structurally simple seat which can be manufactured at relatively low cost is obtained when at least a part of the profiles is tubular. Tubular profiles can be given a desired shape and a desired length in simple manner, and can be connected to each other in simple manner.

For optimal support of a user the cloth can be at least locally thickened, lined and/or padded in an embodiment of the seat. This imparts additional shape to the seat surface and the backrest. The cloth can additionally or instead also be pre-formed, for instance by forming seams and hems therein.

In an embodiment the seat according to the invention comprises a plurality of cloths, one of which is in each case tensioned between the profiles. A cloth can thus be replaced, for instance because it requires cleaning or repairs, or when the material properties thereof deteriorate. The form and function of the seat can also be adapted to a different application or a different user by replacing a cloth. A different sleeve can thus for instance be used for racing games than for a flight simulator, and in the case of a desk chair a "working sleeve" with ergonomics optimal for office work can be replaced with a "gaming sleeve" which is adapted for use by gamers. A single frame can thus be used in different ways.

The invention also relates to a method for forming a seat having a seat surface and a backrest. According to the invention, this method comprises the steps of:

providing a frame which comprises two side profiles lying at a mutual distance and delimiting the seat surface, two side profiles lying at a mutual distance and delimiting the backrest, and an upper profile extending between the side profiles; providing a cloth which defines the seat surface and the backrest and which comprises at an end a folded-back part, as well as at least one strap connected to a side edge; and tensioning the cloth between the profiles by arranging the folded-back part over the upper profile and folding the at least one strap at least partially round the side profiles for the seat surface.

Embodiments of the method are described in one or more dependent claims.

Finally, the invention also relates to a frame and a cloth for application in a seat or method as described above.

Figure 2:
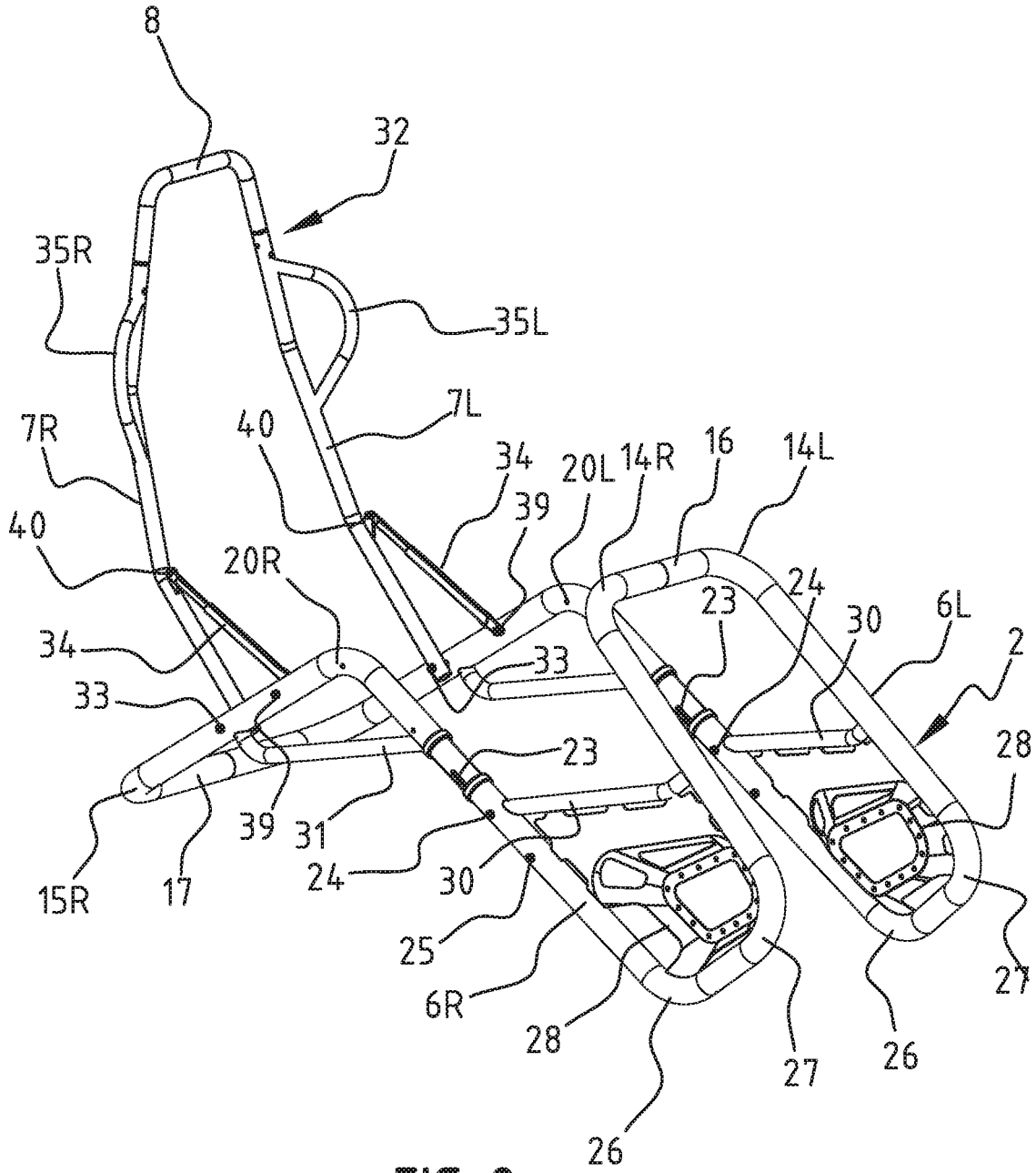
Figure 3:
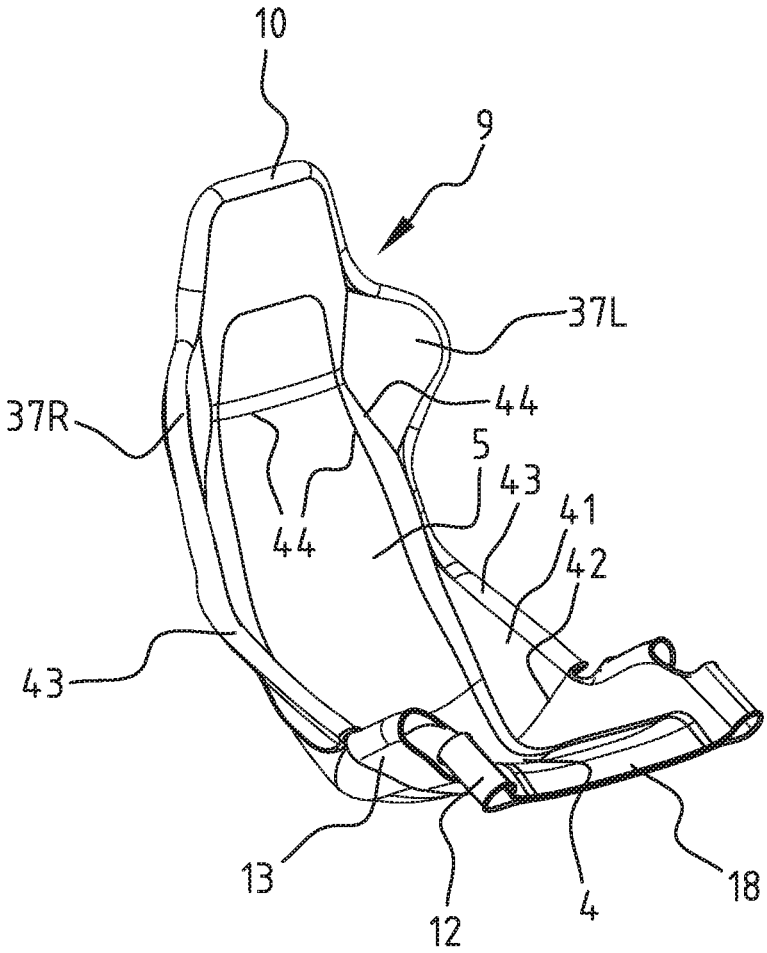
Figure 4:
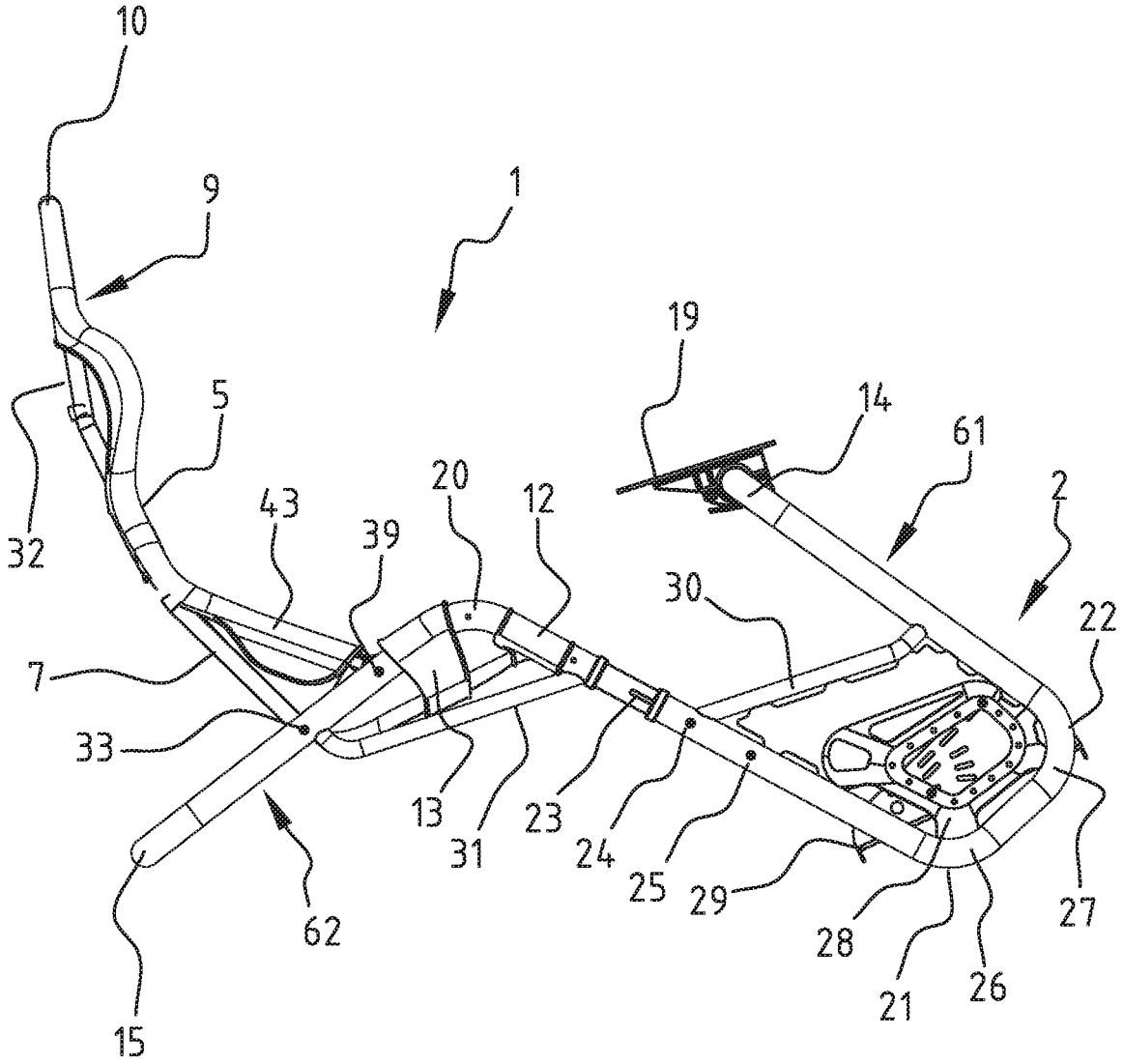
Figure 5:
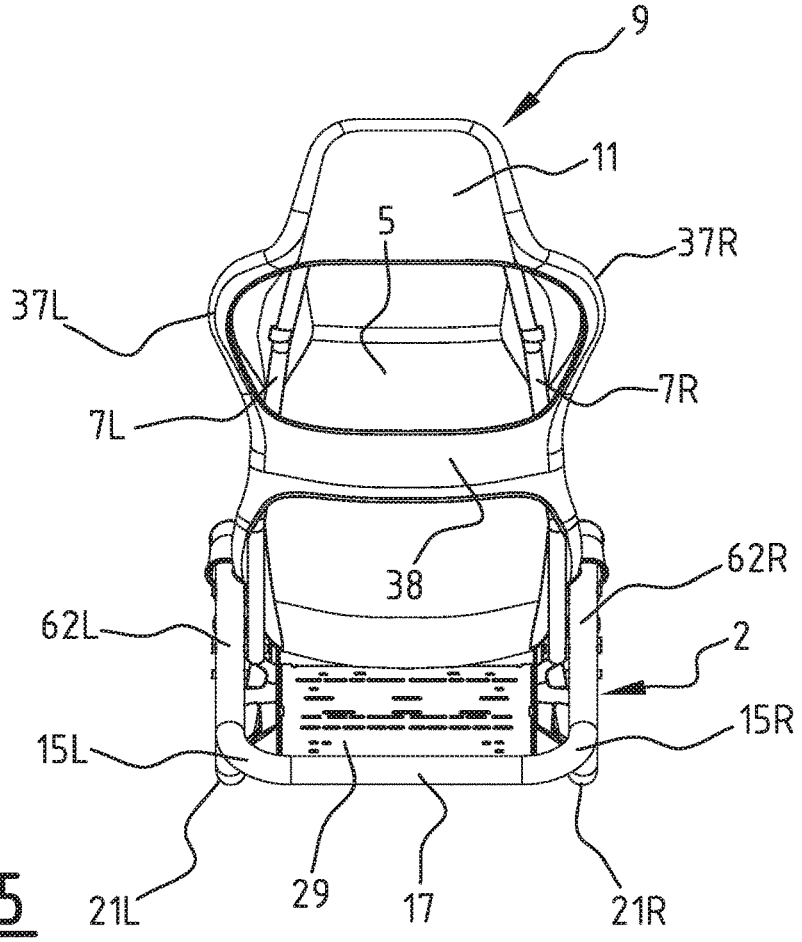
Figure 6:
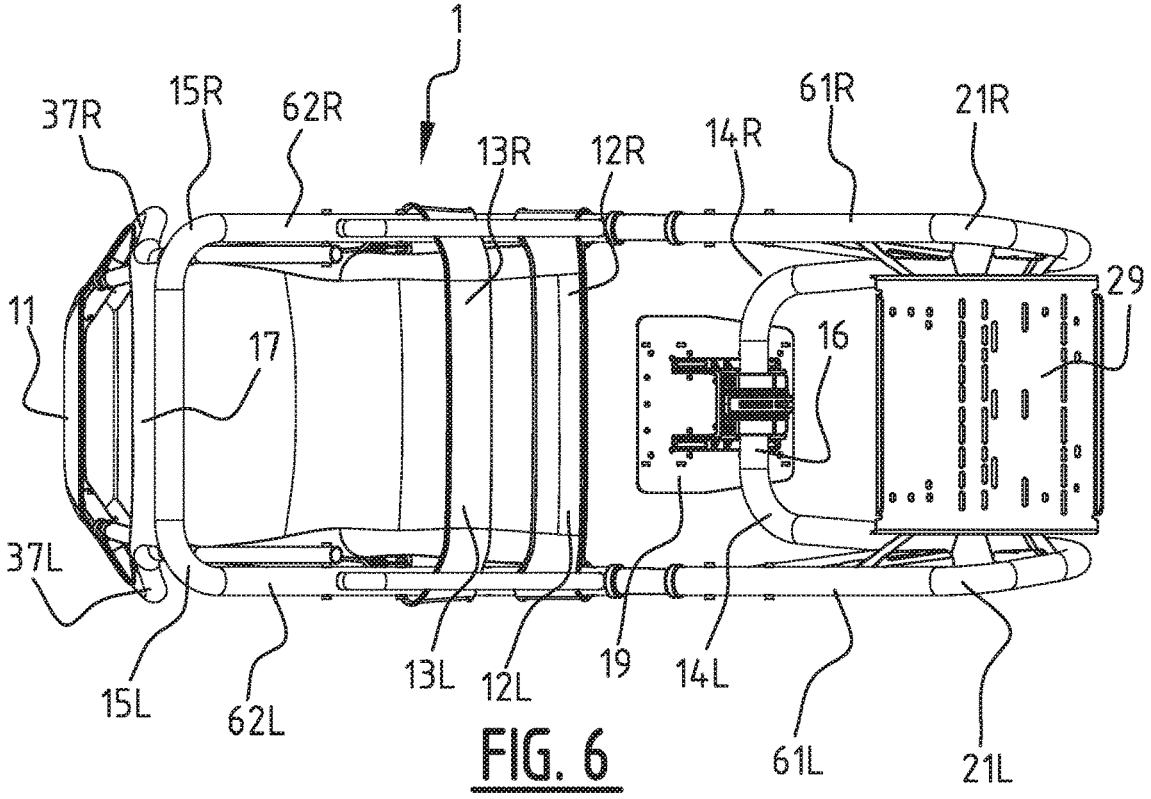
Figure 7:
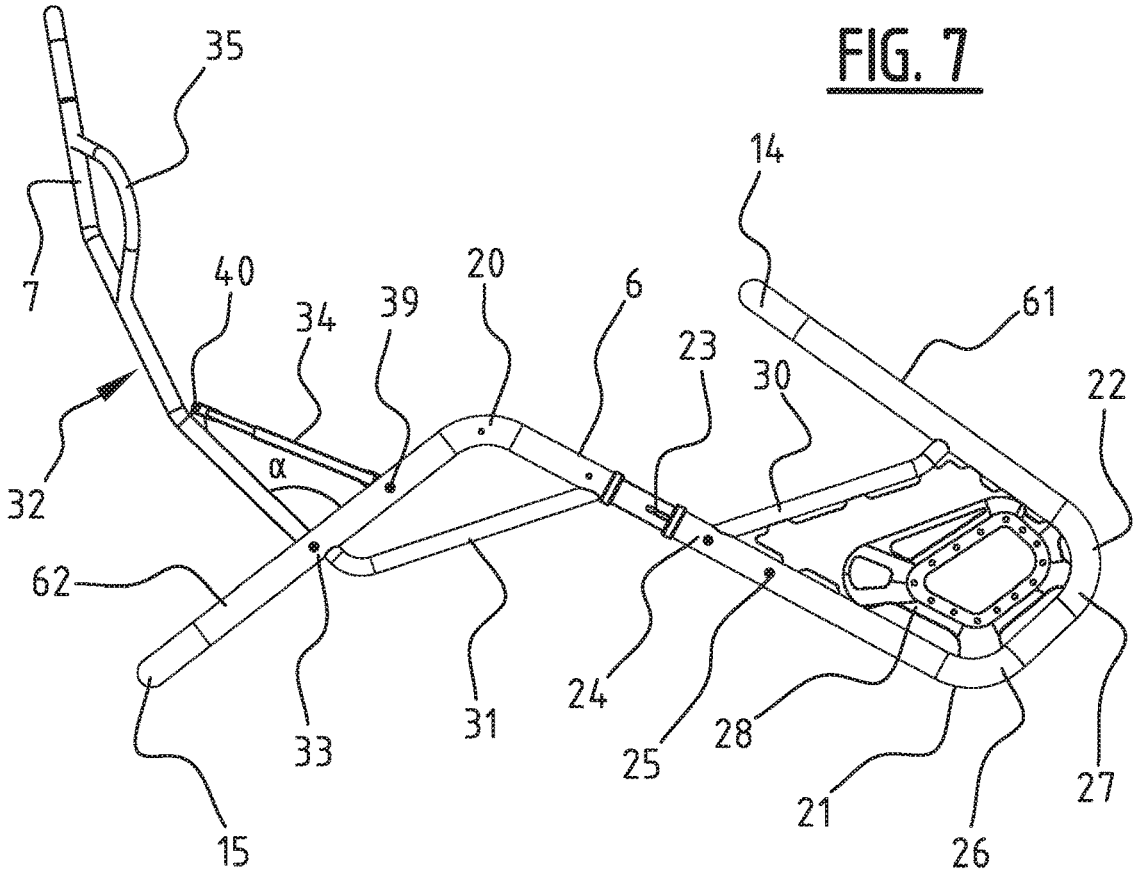
Figure 8:
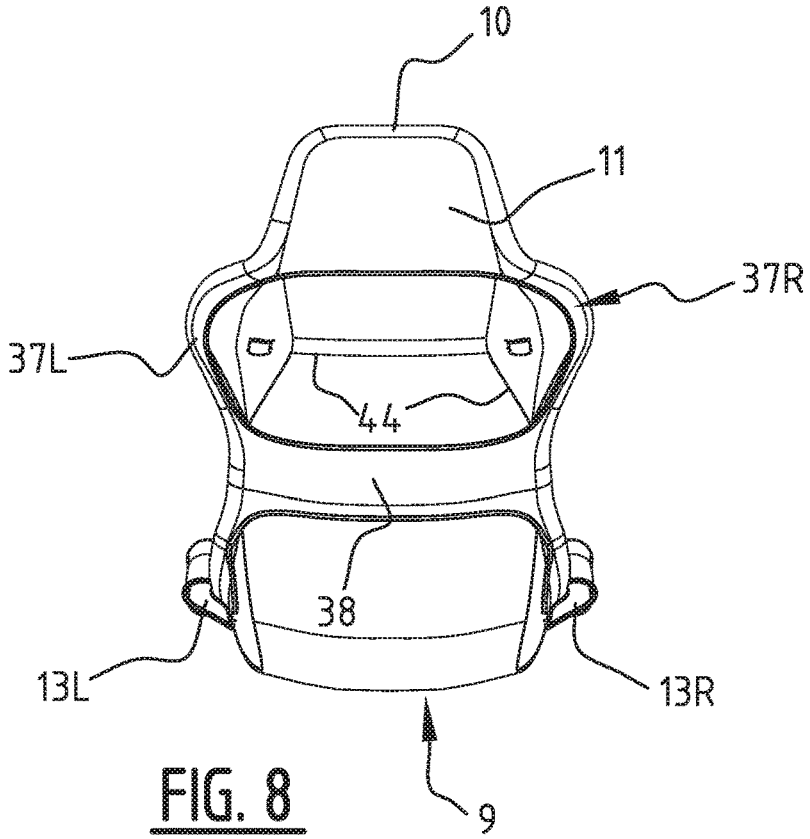
Figure 9:
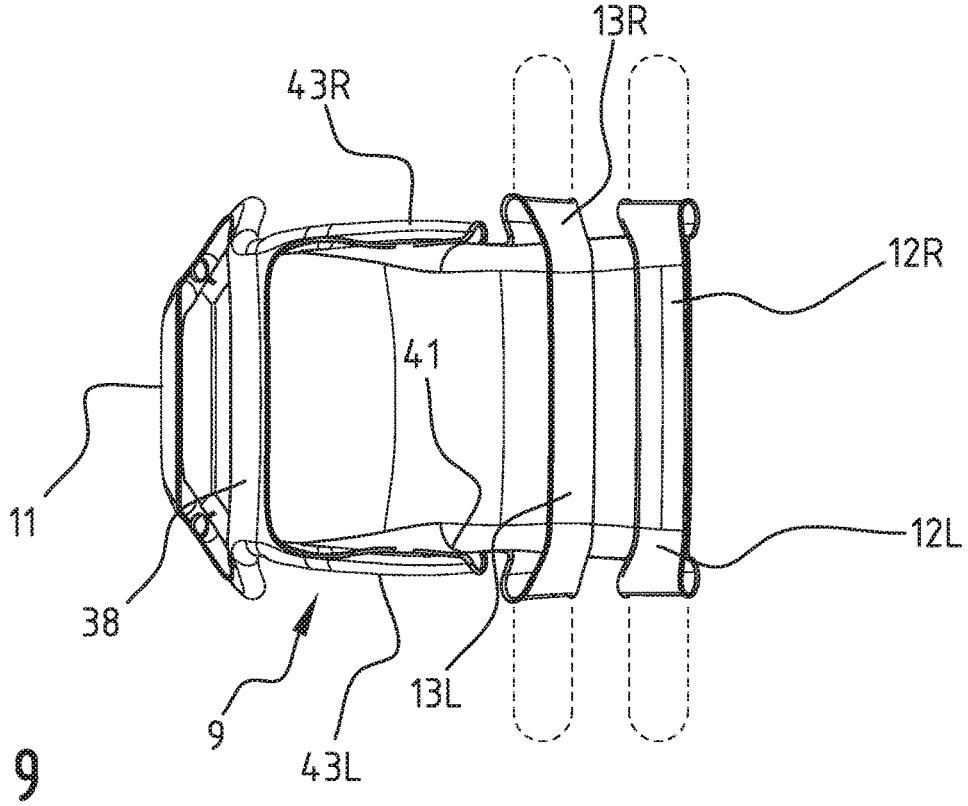
Figure 10:
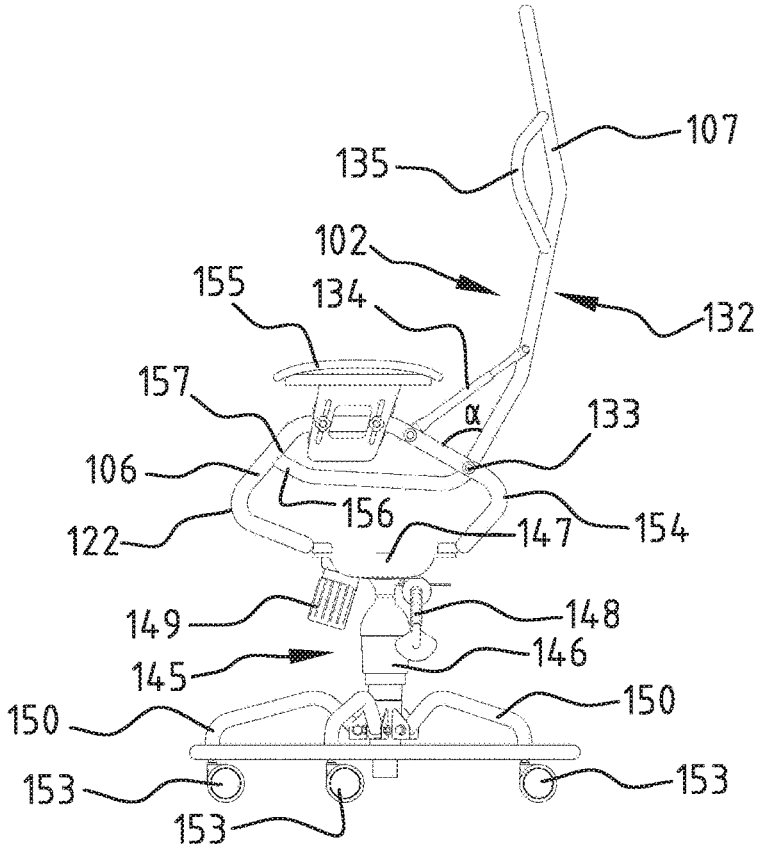
Figure 11:
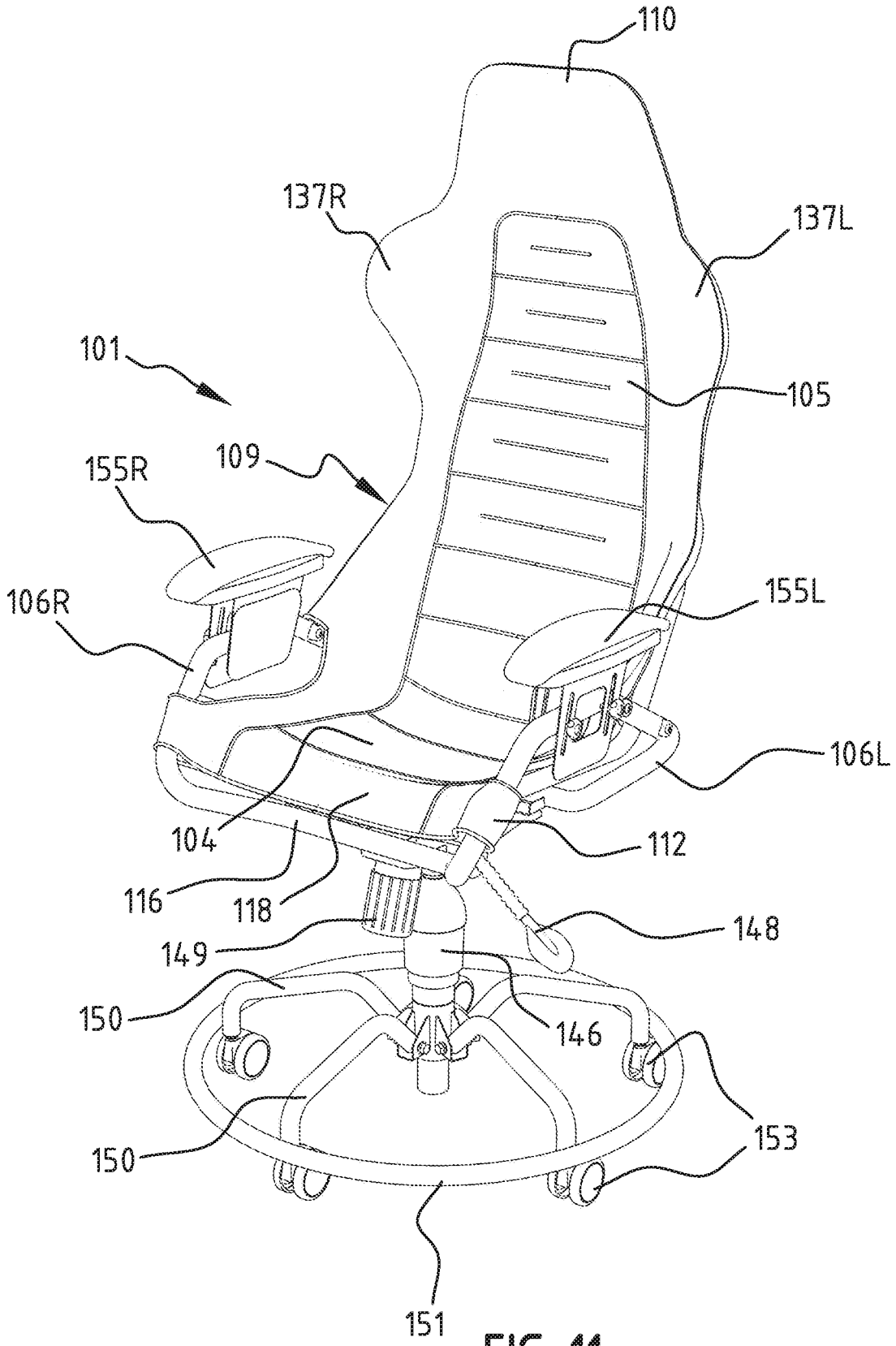
Figure 12:
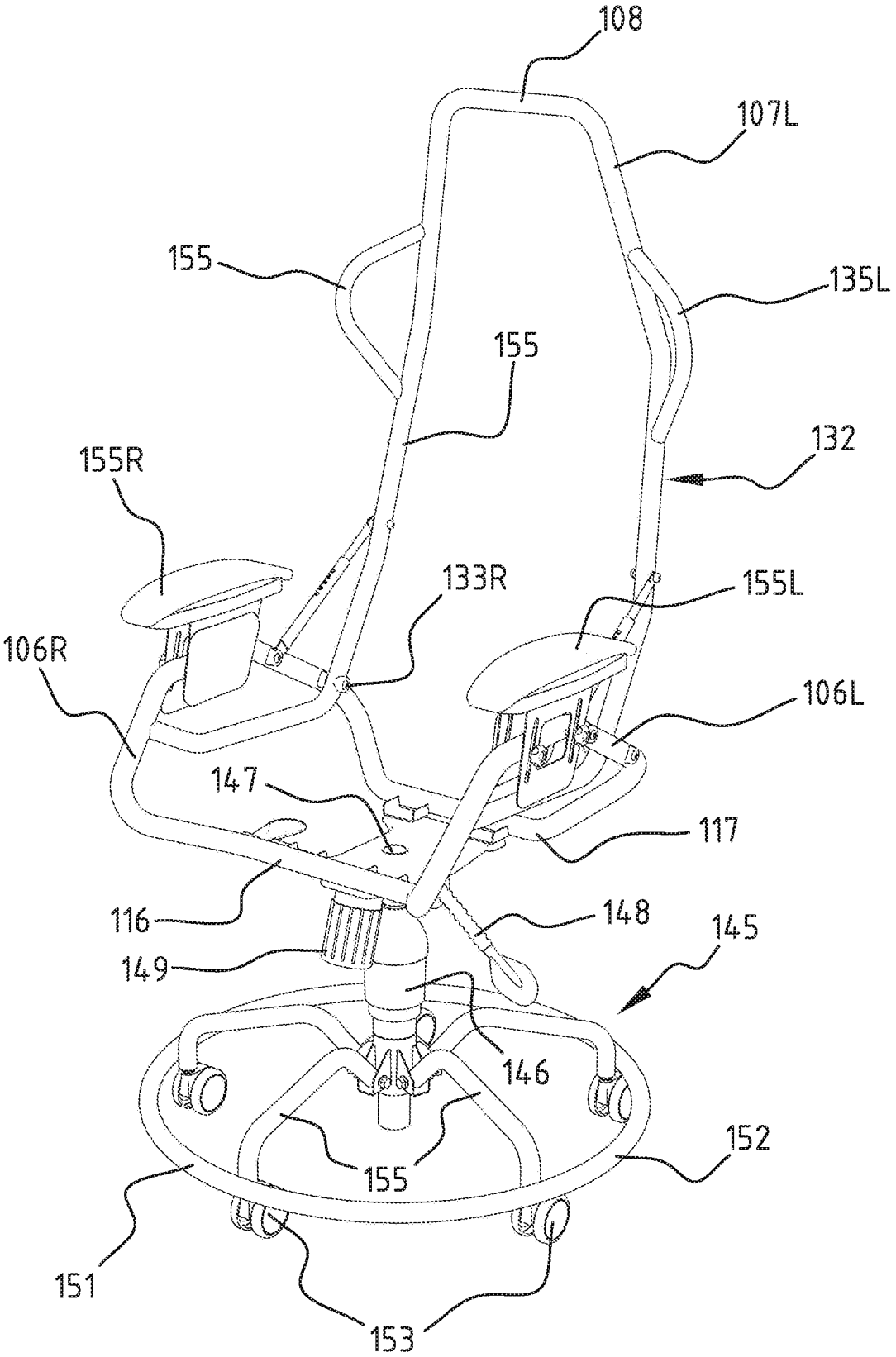
Figure 13:
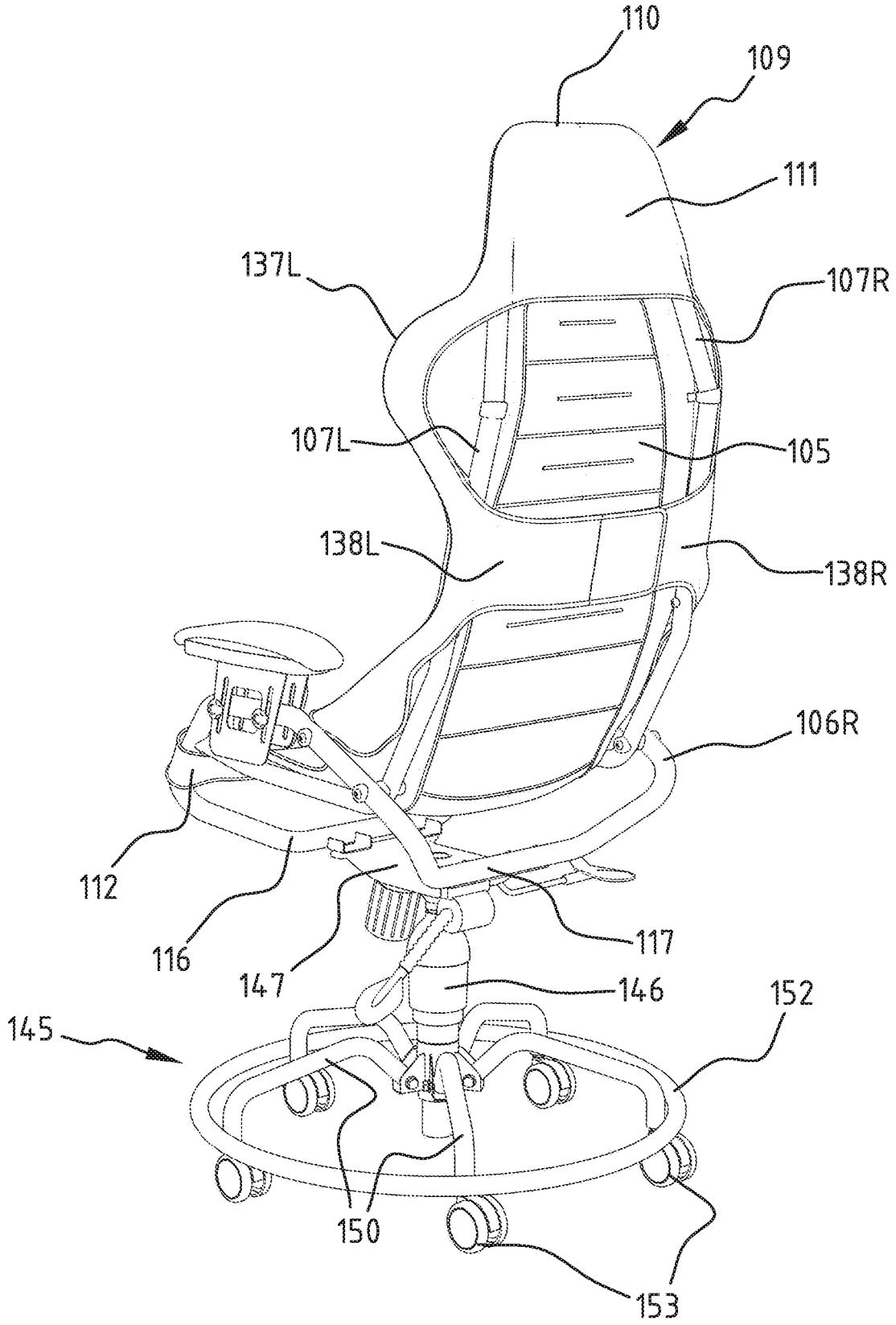
Figure 14:
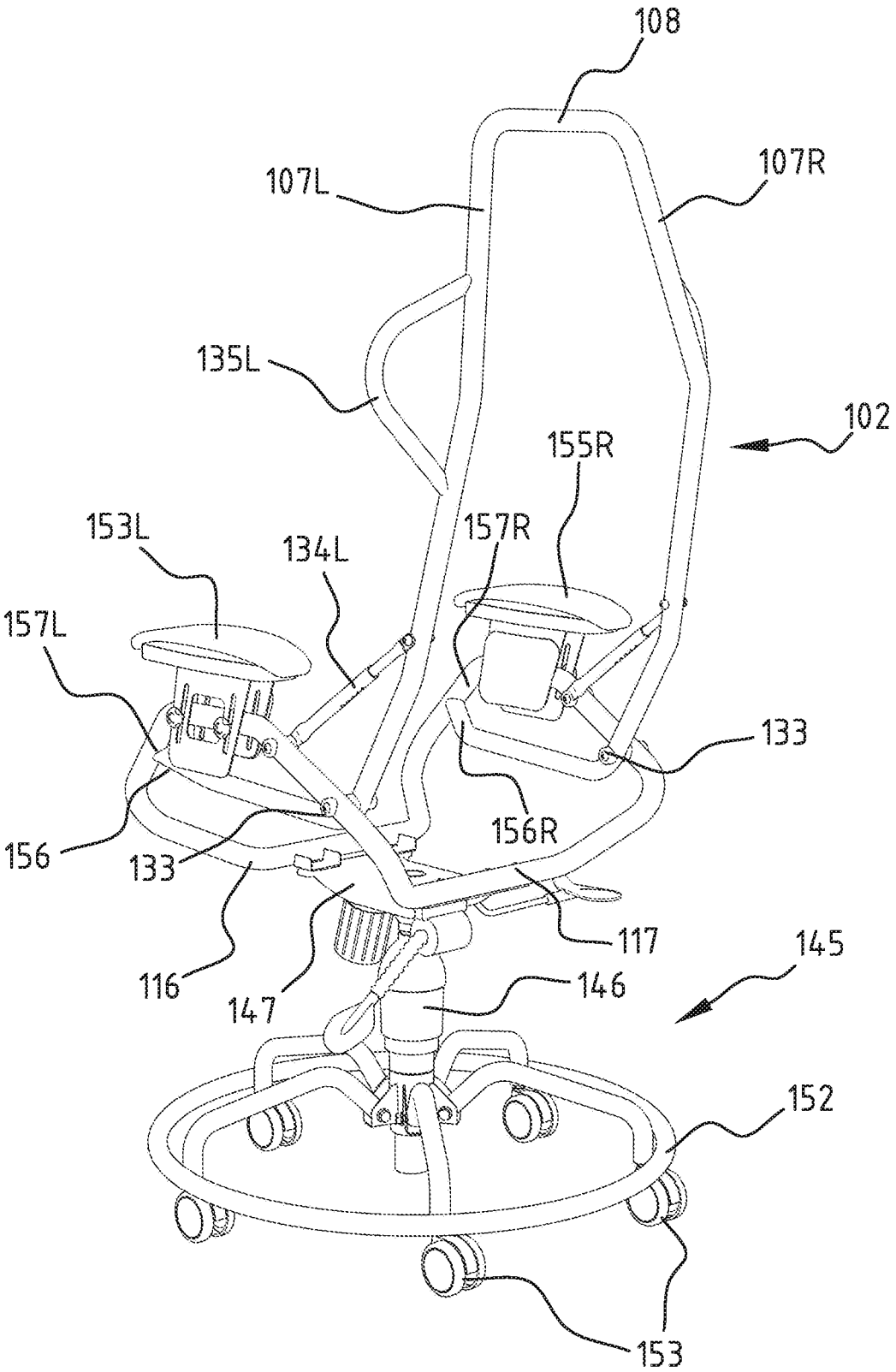

The invention is now elucidated on the basis of a number of embodiments, wherein reference is made to the accompanying drawings in which corresponding components are designated with reference numerals increased in each case by 100, and in which:

FIG. 1 is a perspective view of a seat according to a first embodiment of the invention, FIG. 2 is a view corresponding with FIG. 1 of a frame of the seat, FIG. 3 is a view corresponding with FIGS. 1 and 2 of a cover of the seat, FIG. 4 is a side view of the seat of FIG. 1, FIG. 5 if a rear view of the seat according to the arrow V in FIG. 4, FIG. 6 is a bottom view of the seat according to the arrow VI in FIG. 4, FIG. 7 is a side view corresponding with FIG. 4 of the frame of FIG. 2, FIG. 8 is a rear view corresponding with FIG. 5 of the cover of FIG. 3, FIG. 9 is a bottom view corresponding with FIG. 6 of the cover of FIG. 3, FIG. 10 is a side view of a frame for a second embodiment of the seat, FIG. 11 is a perspective front view of the seat according to the second embodiment, FIG. 12 is a view corresponding with FIG. 11 of the frame of FIG. 10, FIG. 13 is a perspective rear view of the seat of FIG. 11, and FIG. 14 is a view corresponding with FIG. 13 of the frame of FIG. 10.

A seat 1 (FIG. 1) comprises a frame 2 and a cover 3. The seat 1 has a seat surface 4 and a backrest 5. The frame 2 comprises two side profiles 6L, 6R lying at a mutual distance and delimiting the seat surface 4. Frame 2 further comprises two side profiles 7L, 7R lying at a mutual distance and delimiting the backrest 5 (FIG. 2). In addition, frame 2 comprises an upper profile 8 which extends between side profiles 7L, 7R.

The seat surface 4 and backrest 5 of seat 1 are defined by a cloth 9 tensioned between the profiles 6, 7, 8 (FIG. 3). This cloth 9 comprises at an end 10 a folded-back part 11 which encloses the upper profile 8 of frame 2 (FIG. 5). This cloth 3 further comprises at least one strap, and in the shown embodiment even two straps 12, 13, which is/are folded wholly or partially round the side profiles 6L, 6R for seat surface 4 (FIG. 6).

The side profiles 6L, 6R delimiting seat surface 4 here each have a front end 14L, 14R and a rear end 15L, 15R. In the shown example the side profiles 6L, 6R are mutually connected close to their front ends 14L, 14R by a front transverse profile 16, while they are mutually connected close to their rear ends 15L, 15R by a rear transverse profile 17. Cloth 3 here lies clear of both transverse profiles 16, 17. These transverse profiles 16, 17 therefore do not play any part in the tensioning of cloth 3 and, in contrast to other seats, in the seat according to the invention a front edge 18 of seat surface 4 is thus freely suspended.

In the first embodiment shown here the front transverse profile 16 otherwise lies higher than the rear transverse profile 17. This front transverse profile 16 is here configured to receive a control element of a video game. For this purpose a platform 19, on which a steering wheel (not shown here) can for instance be mounted, is clamped onto front transverse profile 16.

The side profiles 6L, 6R delimiting seat surface 4 here each have between their front end 14L, 14R and their rear end 15L, 15R a bent portion 20L, 20R. In the shown embodiment the bent portion 20 lies higher than rear end 15. Side profiles 6L, 6R here each have on either side of bent portion 20 a front lowermost point 21 and a rear lowermost point. In this embodiment the rear lowermost point coincides with rear outer end 15. The front and rear lowermost points 21L, 21R, 15L, 15R thus define four support points of the frame 2 on a ground surface G. Although not shown here, the support points could be provided with for instance rubber caps or other provisions for preventing sliding of frame 2 over the ground surface G.

In the shown embodiment the higher front transverse profile 16 lies between the bent portion 20 and a front point 22 (FIG. 4) of each of the side profiles 6. For this purpose each side profile 6 is on its front side as it were bent back parallel to itself in the direction of seat surface 4 and backrest 5 in that it is provided with two curved portions 26, 27 of about 90 degrees each. A control element arranged on front transverse profile 16 can thus be placed relatively close to backrest 5, whereby a user seated in seat 1 is able to operate the control element in simple manner.

Close to the front point 22 each side of profile 6 is in the shown embodiment provided with means 28 for mounting another control element of a videogame, in this case a set of pedals. These mounting means 28 here comprise a plate with openings which is arranged at the position of the curved portions 26, 27 of side profile 6, between the parallel parts thereof. A pedal support 29 can thus be mounted on frame 2 between side profiles 6L, 6R.

In a simpler embodiment of frame 2 (not shown here) the front transverse profile 16 is not raised, but connects the front lowermost points 21L, 21R of side profiles 6L, 6R. The thus formed frame 2 then has no bent-back part, and the side profiles 6L, 6R both have a reverse V-shape. A seat with such a frame is suitable for video games wherein no control elements need to be placed directly in front of the user, such as for instance games wherein use is only made of one or two joysticks. These joysticks can then be mounted on side profiles 6L. 6R.

In the shown embodiment the side profiles 6L, 6R which delimit seat surface 4 are each length-adjustable between the bent portion 20 and the front transverse profile 16. For this purpose these side profiles 6L, 6R are given a divisible form in the shown embodiment. Each side profile 6L. 6R comprises a front part 61L, 61R and a rear part 62L, 62R. The side profiles 6L, 6R are further given a tubular form, wherein the rear part 62L, 62R of each side profile 6L, 6R comprises a narrowed segment which is telescopically slidable in the front part 61L, 61R. Formed in the narrowed segment of each rear part 62 are mutually opposite slots 23 (only one shown in each case) through which protrudes a pin 24 which is attached to front part 61. The front and rear parts 61, 62 can be fixed relative to each other in different positions by means of a second pin 25 which can be placed into the narrowed segment by one of a series of openings (not shown) as desired. The length of each side profile 6L, 6R, and thereby the position of the steering wheel and the pedals relative to seat surface 4 and backrest 5, can thus be adjusted to the size of a user of seat 1. Because each side profile 6 is relatively elongate, the adjustment range relative to the length of side profile 6 can be relatively limited, whereby adjusting the length has hardly any effect on the angle of seat surface 4 and backrest 5 relative to the ground surface G. The shape of frame 2 therefore hardly varies with the length, so that this single adjustment option can suffice.

In the shown embodiment the front part 61 and the rear part 62 of each side profile 6 for seat surface 4 are further reinforced at the position of curved portions 26, 27 and bent portion 20. For this purpose a lying element 30 is arranged in front part 61 between the part resting on ground surface G and the bent-back part, while in the rear part 62 a lying element 31 is arranged between the part in front of and the part behind the bent portion.

The side profiles 7L. 7R delimiting backrest 5 and the upper profile 8 here form an auxiliary frame 32 which is mounted releasably on the side profiles 6L, 6R delimiting seat surface 4. This auxiliary frame 32 here has a substantially reverse U-shape and, at the ends of the U-shape, is connected pivotally to the side profiles 6L, 6R of seat surface 4 by means of shafts 33. Arranged between each side profile 7L, 7R delimiting backrest 5 and the corresponding side profile 6L, 6R delimiting seat surface 4 is a support 34L. 34R which defines an angle $\alpha$ between the side profiles 6, 7 (FIG. 7). In the shown embodiment the supports 34 are length-adjustable, whereby the angle $\alpha$ can be varied subject to the preferences of a user by a pivoting movement of auxiliary frame 32 round the shafts 33. The ends of each support 34 are connected pivotally to side profiles 6, 7 by means of shafts 39, 40.

The side profiles 7L, 7R delimiting backrest 5 could otherwise extend beyond the connection to the side profiles 6L, 6R for seat surface 4, and these side profiles 7L, 7R could be connected at their lower outer end by a lower profile (not shown here) lying opposite the upper profile 8. In that case the auxiliary frame 32 would have a closed, roughly rectangular form and the cloth 9 could be connected by means of for instance tensioning straps to the lower profile so as to define a lowermost point of seat surface 4 and of backrest 5.

In the shown embodiment the side profiles 7L, 7R delimiting backrest 5 each have a profile part 35L, 35R which protrudes forward out of a main plane of auxiliary frame 32. These profile parts 35L, 35R, which protrude both in and outside the main plane, give the backrest at the position of the shoulders of a user a shape which encloses the body and which is characteristic for racing seats. This enhances the experience of the user.

As stated, a folded-back part 11 of cloth 9 is folded over the upper profile 8 of auxiliary frame 32, and straps 12, 13 are folded round the side profiles 6L, 6R for seat surface 4. In the shown embodiment a first strap 12 is here folded round the relevant side profile 6 in front of bent portion 20, and a second strap 13 behind bent portion 20 (FIG. 1). Hereby, the part of the cloth 9 that defines seat surface 4 roughly follows the shape of side profiles 6L, 6R and a depending front edge 18 of the seat surface is defined, which supports the legs of a user in comfortable manner.

In the shown embodiment the straps 12, 13 consist of two parts, respectively 12L, 12R and 13L, 13R, which are each connected to a side edge 36 of cloth 9 and which together span the whole width of seat surface 4. These strap parts 12L, 12R and 13L, 13R can be connected to each other under or adjacently of seat surface 4, for instance by velcro (FIGS. 6, 9). Instead of strap parts 12, 13 which cover the whole width of seat surface 4, it is otherwise also possible to envisage application of relatively short strap parts, which are connected directly to the underside of seat 4, once again using for instance velcro, after being folded round a corresponding side profile 6L or 6R.

Cloth 9 has here under the folded-back part 11 two shoulders 37L, 37R which are tensioned over the protruding profile parts 35L, 35R of auxiliary frame 32. Under these shoulders 37 the cloth 9 has in this embodiment another strap 38 which extends behind the side profiles 7L, 7R of backrest 5 (FIGS. 5, 8). When the material of cloth 9 is sufficiently elastic, this strap 38 can take an integral form and is pulled over side profiles 7L, 7R when cloth 9 is tensioned on frame 2. It is however also possible to envisage this strap 38 consisting of two parts, each being connected to one of the side edges 36 of cloth 9, and once again being attached to each other with for instance velcro.

In this embodiment the cloth 9 is otherwise pre-formed to some extent so that it follows the contours of frame 2. Along side edges 36 the cloth 9 is provided locally with upright parts 41, the shape of which is held by seams 42 and which simulate wings of a bucket seat (FIG. 3). These upright parts 41 here further each have a folded edge 43 which covers the corresponding support 34 of frame 2. Cloth 9 can further form a profiled backrest 5 by means of seams 44 arranged therein. In addition, cloth 9 can be locally thickened, lined and/or padded. This can provide additional support for determined body parts of the user.

For use of seat 1 the front part 61L, 61R of each side profile 6L, 6R is connected to the rear part 62L, 62R. The two front parts 61L, 61R are already connected to each other by front transverse profile 16, while the rear parts 62L, 62R are already connected to each other by rear transverse profile 17. The auxiliary frame 32 is then connected to the two side profiles 6L, 6R, after which cloth 9 is pulled over the thus formed frame 2. The straps 12, 13 are then folded round side profiles 6L, 6R, and the strap 38 is then optionally also folded round side profiles 7L, 7R. By tensioning the straps 12, 13, 38 to sufficient extent the cloth 9 is tensioned tightly onto frame 2, whereby a sturdy yet comfortable seat 1 is obtained.

When cloth 9 eventually requires cleaning or repairs, it can simply be removed from frame 2 and tensioned onto frame 2 again after cleaning or repairs. The cloth can optionally also be temporarily replaced with another cloth. When cloth 9 has reached the end of its lifespan, frame 2 will generally still be usable. Cloth 9 can then be replaced with a new cloth in simple manner. In addition, cloth 9 can be exchanged in order to give seat 1 a different function. A cloth mimicking a racing seat of a formula car can thus for instance be replaced with a different type of cloth which simulates an ejector seat of a fighter plane.

In an alternative embodiment of seat 101 (FIG. 10) the front and rear transverse profiles 116, 117 of frame 102 are each mounted on an undercarriage 145. In the shown embodiment this undercarriage 145 comprises a central leg 146 having on its upper side a carrier 147 on which the front and rear transverse profiles 116, 117 are mounted.

The undercarriage 145 can be a conventional undercarriage for a desk chair and have the usual adjustment options. The central leg 146 can thus be adjustable in longitudinal direction, for instance by means of a gas spring, a lock of which is operated by means of a handle 148. In this way the height of seat surface 104 of seat 101 can be adjusted. Carrier 147, and thereby frame 102 as well, can additionally be rotatable about a vertical longitudinal axis A of the central leg 146. The carrier, and thereby frame 102, can optionally also be pivotable about a horizontal axis in order to adjust the seating angle of seat surface 104. The various adjustment options can be operated by means of a rotary knob 149 on the underside of carrier 147.

In the shown embodiment undercarriage 145 is of the type described in the earlier patent WO 2018/030894 A1 of applicant, with feet 150 which are pivotally connected to the central leg 146 and a support ring 152 constructed from segments 151. The feet are here provided at their outer ends remote from central leg 146 with swivel wheels 153.

In this embodiment the side profiles 106L, 106R for seat surface 104 have multiple bends, whereby the front transverse profile 116 lies below and behind the front point 122 of each side profile 106, while the rear transverse profile 117 lies below and in front of a rear point 154 of each side profile 106. Between two bent portions each side profile 106L. 106R has on the upper side a horizontal segment on which a height-adjustable armrest 155 is mounted.

In this embodiment the side profiles 107L, 107R delimiting the backrest also form together with an upper profile 108 an auxiliary frame 132 with a reverse U-shape, which is once again connected to the side profiles 106L. 106R delimiting seat surface 104 for pivoting about shafts 133 (FIG. 12, 14). In this embodiment the side profiles 107L, 107R of backrest 105 extend forward beyond shafts 133. In side view the profile parts 107L, 107R are substantially L- or J-shaped. A front outer end 156 of each side profile 107 of backrest 105 is here received for being moved in the height in a slotted hole 157 in the corresponding side profile 106 of seat surface 104. Supports 134 with variable length are here also arranged on either side for adjustment of the angle $\alpha$ between the side profiles 106, 107 of respectively seat surface 104 and backrest 105.

As in the first embodiment, the seat surface 104 and the backrest 105 are here also defined by a cloth 109 tensioned between profiles 106, 107 and 108. This cloth once again comprises at an end 110 a folded-back part 111 which encloses the upper profile 108 of the auxiliary frame 132 (FIG. 13). Cloth 109 here additionally comprises a strap consisting of two parts 138L, 138R and extending behind the side profiles 107L. 107R of backrest 105, and a strap 112 which is folded round the two side profiles 106L, 106R of seat surface 104 close to the front point 122. In this embodiment the front and rear transverse profiles 116, 117 do not play a part in the tensioning of cloth 109 either, so that the front edge 118 of seat surface 104 is freely suspended once again. Cloth 109 can here also be exchanged in order to give seat 101 a different function. A cloth which is ergonomically optimized for working at a screen can thus for instance be replaced by a different type of cloth adapted for use of the seat by a gamer.

Owing to the shown construction of seat 1, 101, with a frame 2, 102 having (in the first embodiment divisible) side profiles 6, 106 for seat surface 4, 104, and a releasable auxiliary frame 32, 132 for backrest 5, 105, and a cloth 9, 109 tensioned over the frame 2, 102 and forming the cover, seat 1, 101 can be packaged and stored very small. By taking apart the different frame parts and folding the cloth the seat takes up little space when it is stored temporarily. And by exchanging the releasable cloth 9, 109 the seat 1, 101 can be made suitable for different function in simple and rapid manner.

Although the invention was described here with reference to a number of embodiments, it will be apparent that it is not limited thereto. Frame 2, 102 can thus be embodied differently than shown here and consist of more or fewer separate components. Instead of the shown tubular profiles, other profile shapes could also be used. The form and embodiment of the cloth can also be varied. Instead of a single cloth for seat surface and backrest, the seat surface and backrest could optionally be formed by separate cloths.

The scope of the invention is defined solely by the following claims.

The invention claimed is:

1. A seat, comprising:

a frame and a cover, wherein the seat has a seat surface and a backrest, wherein the frame comprises two side profiles lying at a mutual distance and delimiting the seat surface, two side profiles lying at a mutual distance and delimiting the backrest, and an upper profile extending between the side profiles of the backrest, and wherein the seat surface and the backrest are defined by a cloth tensioned between the profiles, which cloth comprises at an end a folded-back part enclosing the upper profile, and at least one strap folded at least partially round the side profiles for the seat surface, wherein the side profiles delimiting the seat surface each have a front and rear end, wherein the side profiles of the seat surface are mutually connected close to the front and rear ends by a front and a rear transverse profile, and wherein the cloth lies clear of the two transverse profiles, and wherein the front transverse profile lies higher than the rear transverse profile, and is configured for receiving a control element of a video game.

2. The seat according to claim 1, wherein the side profiles delimiting the seat surface each have between their front and rear end a bent portion which lies higher than at least one of the front and rear ends.

3. The seat according to claim 1, wherein the side profiles delimiting the seat surface each have between their front and rear end a bent portion which lies higher than at least one of the front and rear ends; and wherein the higher front transverse profile lies between the bent portion and a front point of each of the side profiles.

4. The seat according to claim 2, wherein the side profiles delimiting the seat surface are each length-adjustable between the bent portion and the front transverse profile.

5. The seat according to claim 4, wherein the side profiles delimiting the seat surface are each divisible between the bent portion and the front transverse profile.

6. The seat according to claim 2, wherein the side profiles delimiting the seat surface have on either side of the bent portion a front and rear lowermost point, and the lowermost points define support points of the frame on a ground surface.

7. The seat according to claim 2, wherein the cloth comprises at least two straps which extend at least partially under the side profiles for the seat surface and which are folded round the relevant side profile on either side of the bent portion.

8. The seat according to claim 1, wherein each transverse profile is mounted on an undercarriage.

9. The seat according to claim 8, wherein the undercarriage comprises a central leg and the frame is rotatable about a longitudinal axis of the central leg.

10. The seat according to claim 1, wherein the side profiles delimiting the backrest and the upper profile form an auxiliary frame which is mounted releasably on the side profiles delimiting the seat surface.

11. The seat according to claim 10, wherein a support which determines an angle between the side profiles is arranged between each side profile delimiting the backrest and the corresponding side profile delimiting the seat surface.

12. The seat according to claim 11, wherein the supports are adjustable and the auxiliary frame is connected movably to the side profiles delimiting the seat surface.

13. The seat according to claim 10, wherein the side profiles delimiting the backrest each have a profile part protruding forward from a main plane of the auxiliary frame.

14. The seat according to claim 10, wherein the auxiliary frame has a substantially reverse U-shape.

15. The seat according to claim 10, wherein a lower profile further extends between the side parts delimiting the backrest, and the cloth is connected to the lower profile.

16. The seat according to claim 1, wherein the cloth comprises at least one strap extending at least partially behind the side profiles for the backrest.

17. The seat according to claim 1, wherein at least a part of the profiles is tubular.

18. The seat according to claim 1, wherein the cloth is at least locally thickened, lined and/or padded.

19. The seat according to claim 1, further comprising a plurality of cloths, one of which is in each case tensioned between the profiles.

20. A method for forming a seat having a seat surface and a backrest, comprising the steps of:

providing a frame which comprises two side profiles lying at a mutual distance and delimiting the seat surface, two side profiles lying at a mutual distance and delimiting the backrest, and an upper profile extending between the side profiles, providing a cloth which defines the seat surface and the backrest and which comprises at an end a folded-back part, as well as at least one strap connected to a side edge, and tensioning the cloth between the profiles by arranging the folded-back part over the upper profile and folding the at least one strap at least partially round the side profiles for the seat surface, wherein the side profiles delimiting the seat surface each have a front and rear end, wherein the side profiles are mutually connected close to the front and rear ends by a front and a rear transverse profile, and wherein the cloth lies clear of the two transverse profiles, and wherein the front transverse profile lies higher than the rear transverse profile, and is configured for receiving a control element of a video game.

21. The method according to claim 20, wherein the side profiles delimiting the seat surface each have a front and rear end and are connected to each other close to at least one of the ends by a transverse profile, and wherein the cloth tensioned between the profiles without connecting it to the transverse profile.

22. The method according to claim 20, wherein the side profiles delimiting the seat surface each have between their front and rear end a bent portion, and wherein the cloth comprises at least two straps which extend at least partially under the side profiles for the seat surface and which are folded round the relevant side profile on either side of the bent portion.

23. The method according to claim 20, wherein the side profiles delimiting the backrest and the upper profile are formed into an auxiliary frame which can be mounted releasably on the side profiles which delimit the seat surface in order to form the frame.

24. The method according to claim 23, wherein a support which determines an angle between the side profiles is arranged between each side profile delimiting the backrest and the corresponding side profile delimiting the seat surface; and wherein the auxiliary frame is connected movably to the side profiles delimiting the seat surface, and the supports are adjusted to move the auxiliary frame to a determined angular position.

25. The method according to claim 23, wherein a lower profile further extends between the side parts of the auxiliary frame, and the cloth is connected to the lower profile; and/or wherein the cloth between the folded-over part and the strap connected to the side edge comprises at least one further strap which is folded at least partially round the side profiles for the backrest.

26. The method according to claim 20, further comprising of detaching the cloth from the profile and tensioning a different cloth between the profiles.

* * * * *